United States Patent [19]

Edlund

[11] 4,126,522

[45] Nov. 21, 1978

[54] METHOD OF PREPARING ALUMINUM WIRE FOR ELECTRICAL CONDUCTORS

[75] Inventor: Per-Olof G. Edlund, Stockholm, Sweden

[73] Assignee: Telefonaktiebolaget L M Ericsson, Stockholm, Sweden

[21] Appl. No.: 759,247

[22] Filed: Jan. 13, 1977

Related U.S. Application Data

[63] Continuation-in-part of Ser. No. 712,670, Aug. 9, 1976, abandoned, which is a continuation of Ser. No. 639,990, Dec. 11, 1975, abandoned, which is a continuation of Ser. No. 448,980, Jul. 16, 1974, Pat. No. 3,901,670, which is a continuation of Ser. No. 294,793, Oct. 4, 1972, abandoned.

[51] Int. Cl.[2] ..... C25D 5/44; C25D 7/06; C23G 1/12

[52] U.S. Cl. ..... 204/28; 204/33; 134/41; 156/665

[58] Field of Search ..... 204/28, 33; 134/41; 156/47, 665

[56] References Cited

U.S. PATENT DOCUMENTS 3,220,899 11/1965 Leonard ..... 156/665

FOREIGN PATENT DOCUMENTS 566,523 11/1958 Canada ..... 204/33

OTHER PUBLICATIONS

"Cleaning and Etching Aluminum," S. Spring; Metal Finishing, Aug. 1968, p. 6671.

*Primary Examiner*—John H. Mack
*Assistant Examiner*—William Leader
*Attorney, Agent, or Firm*—Hane, Roberts, Spiecens & Cohen

[57] ABSTRACT

Aluminum wire, of either pure aluminum or an aluminum alloy is plated with a firm layer of nickel by passing the wire through a pickling bath of an aqueous solution of phosphoric and hydrochloric acids at a temperature of between 50° and 70° C and then electroplating the wire with nickel.

7 Claims, No Drawings

METHOD OF PREPARING ALUMINUM WIRE FOR ELECTRICAL CONDUCTORS

CROSS-REFERENCE TO RELATED APPLICATIONS

This invention is a continuation-in-part of copending application, Ser. No. 712,670, filed Aug. 9, 1976, now abandoned, which is in turn a continuation of application Ser. No. 639,990 filed Dec. 11, 1975, now abandoned, which is in turn a continuation of application Ser. No. 448,980 filed July 16, 1974, now Pat. No. 3,901,670, which is in turn a continuation of application Ser. No. 294,793 filed Oct. 4, 1972, now abandoned.

BACKGROUND OF THE INVENTION

This invention relates to improved wires or cables of aluminum or alloys of aluminum and particularly to processes for treating aluminum wire with a pickling bath and thereafter plating the treated wire with nickel.

Wires and cables used as electrical conductors have been primarily made of copper. In recent years for economic reasons aluminum has been used in place of the more expensive copper. However, while aluminum is cheaper than copper, aluminum has certain disadvantages such as inferior mechanical properties and lower conductivity. Another serious disadvantage of aluminum and alloys thereof is the difficulty to make good contacts with themselves or other metals. For example, an aluminum wire cannot be readily soldered to another aluminum wire or to another metal. This makes it difficult and very dangerous to use aluminum wires or cables for instance in house wiring. When the term "aluminum" is used hereinafter, it shall refer to both the aluminum metal and alloys of aluminum.

To obtain aluminum wire free of the aforeindicated disadvantages, aluminum wire has been coated with other metals such as copper to obtain aluminum-metal bonds. These coated wires have better conductivity and make better contacts. Such coatings can be obtained by heat-treatment of the aluminum with the metal copper as described in Texas Instruments Bulletin No. 516-TB 25-468 or through electrochemical deposition of the metal on the aluminum. However, the bonds between the coating and the aluminum were not strong and on use the coating frequently rubbed off or peeled off. Furthermore, the process was not readily controllable to provide a coating of both uniform and desired thickness. Usually, the coatings were thicker than desired, thereby increasing the costs and reducing the ductility of the coated wires. Desirably, the thickness of the coating should be about 1.0 to 1.5 microns.

These deficiencies were overcome in U.S. Pat. No. 3,867,265 wherein an aluminum wire, of either pure aluminum or an aluminum alloy, is plated with a firm layer of at least one of nickel, copper, tin, zinc or cadmium by treating the wire with an aqueous solution of hydrofluoric and hydrochloric acids and then electroplating the wire with the metal. The electrolyte is a solution of a fluoroborate or sulfamate of the metal. The aluminum wire so plated possesses superior conductivity and may be readily soldered.

However, it has been found that the preferred plating material is nickel. It has also been found that the pickling step of the process creates several problems. Aluminum bodies are difficult to pickle so that the requisite degree of surface purity for a subsequent electroplating will be obtained. This depends primarily on the preventive oxide film which covers the aluminum. It is certainly not especially thick, but it is still a problem partly because of the speed with which it reforms. A special problem is the silicon which exists in aluminum, as an alloying constituent in some cases or as impurity in other cases. After pickling in conventional baths, which are either acid or basic, there often remain small areas of silicon containing films. To remove these silicon containing films one must resort to strong acid-baths which contain hydrofluoric acid as in the above-mentioned U.S. Patent. Such pickling baths have however the disadvantage that a very uneven and unnecessarily strong etching of not-silicon-containing surface areas is obtained. Another disadvantage is that hydrofluoric acid is very poisonous and it easily causes a state of illness for those who work with it, thus requiring that strict measures of precaution be taken.

SUMMARY OF THE INVENTION

The present invention has an object of pickling aluminum wire for subsequent nickel plating by rapidly passing the wire through a pickling bath with a high degree of refining in combination with a low rate of poisonousness, which makes the bath easy to work with.

Another object of the invention is to plate aluminum wire with nickel.

In accordance with the invention a method for preparing an aluminum wire for electrical conductors includes pickling the aluminum wire by passing it through an acid bath consisting of an aqueous solution containing 20–35% by volume of 35% hydrochloric acid and 5–13% by volume of 85% phosphoric acid with the bath having a temperature of between 50° and 70° C.

DESCRIPTION OF THE PREFERRED EMBODIMENT

In practicing the invention the aluminum wire may be of substantially pure aluminum metal or a suitable alloy thereof such as, for example: aluminum 98.5 - 99.8%, iron 0.2–1.5%; aluminum 99.1 %, iron 0.15% magnesium 0.15%; or aluminum 99.46%, copper 0.40%, magnesium 0.14%.

The aluminum wire is preferably cleaned prior to the pickling or acid treatment by removing any metallic or other particles adhering thereto and then by disclosing any greases or lubricants on the wire in a suitable solvent, such as ethylene dichloride or carbon tetrachloride. The solvent is preferably volatile so little time will elapse between the solvent treatment and the following acid treatment.

The next step is to pickle the aluminum wire by passing it through an acid bath. The time spend in the bath is from 7 to 20 seconds, and preferably 13.33 seconds.

The preferred constitutions for a pickling or acid bath according to this invention lay between the following limits relating to the bath:

20–35% by volume of 35% hydrochloric acid; and

5–13% by volume of 85% orthophosphoric acid and the preferred working temperature between 50° and 70° C.

A very fast and uniformly working pickling bath, which gives dense and even surface films at a subsequent electroplating with nickel is obtained when the bath contains about 30% by volume hydrochloric acid and about 10% by volume phosphoric acid and has a working temperature of around 60° C.

Such a bath is very well suited for machines for continuous electroplating of aluminum wire for it makes it possible to use a high coating speed. Pickling or acid baths according to this invention permit, because of their comparatively low degree of toxicity, simpler machine constructions, through which the operation can be made safer.

After leaving the acid bath the wire is passed through hot water to remove any adhering acid.

Thereafter, the aluminum wire is passed through an aqueous electrolyte containing one or more salts of the nickel which is to be plated on the aluminum wire between anodes of the metal. While numerous salts can serve as electrolytes, it is preferred to use the fluoroborate or sulfamate salts in concentrations of about 200 to 250 g. per liter. In addition, there may be added to the electrolyte about 1 g. per liter each of the free acid and of the metal.

The pH of the elctrolyte solution is about 2 and may be varied between a range of about 2 to 2.5.

The electroplating may be carried out at a temperature of about 20° C. to 60° C., but is preferably carried out at about 40° C.

The current density and voltage can be varied to suit the conditions under which the process is practiced. It has been found that a current density of about 20 amp/dm$^2$ and a voltage of about 6 volts are satisfactory.

The following is an example of a nickel plating of aluminum wire wherein the wire is serially drawn from an acid bath via a washing bath to a plating bath.

| | |
|---|---|
| Length of the wire path in the acid bath in m | about 80 |
| length of the wire path in the plating bath in m | about 80 |
| Length of the wire path in the hot water washing in m | 4.3 |
| Wire speed in m/sec | about 6 |
| Time wire is in acid bath | about 13.3 sec. |
| Acid bath formula: | |
| 35% hydrochloric acid | 30% by volume |
| 85% phosphoric acid | 10% by volume |
| Water | 60% by volume. |
| Plating bath formula: | |
| Nickelfloroborate, g/l | 683 |
| Nickel, g/l | 172 |
| Free boric acid, g/l | 33 |
| Acid bath working conditions: | |
| Temperature, ° C | 60 |
| Plating bath working conditions: | |
| Temperature, ° C | 40 |
| pH, colorimetric | 2.0 |
| Current density, Amp/dm$^2$ ca | 20 |
| Bath voltage, V ca | 6 |
| Anode: Depolarised nickelplates | |
| Pickling or acid and plating bath | |

-continued

| | |
|---|---|
| volumes in circulation, liter | 500 |

Under the conditions described, an aluminum wire 2.5 mm$^2$ in cross-sectional area will be plated with a nickel coating having a thickness of 1.5 microns.

By means of the above-described process, the nickel coating is built up as a layer of connected islands completely covering and penetrating the aluminum surface so that all small porosities are filled with nickel. Thus a very strong bond is established between the aluminum surface and the nickel coating.

The nickel coated aluminum wire prepared by the process described has the same excellent contact properties as a copper wire and may be tin soldered in the same way as a copper wire. It may be drawn to smaller dimensions without losing its contact properties. Even subsequent hot tinning may be carried out with excellent results and hot tinned wire has the same smooth and bright surface as a hot tinned copper wire.

What is claimed is:

1. The method of preparing an aluminum wire for subsequent nickel plating for electrical conductors comprising passing the wire through an acid bath consisting of an aqueous solution containing 20 -35% by volume of 35% hydrochloric acid and 5 -13% by volume of 85% phosphoric acid, said bath having a temperature of between 50° and 70° C.

2. The method of claim 1 further comprising the step of electroplating nickel on the surface of the aluminum wire after it has passed through the acid bath.

3. The method of claim 2 wherein the volume of the hydrochloric acid is 30%, the volume of the phosphoric acid is 10%, the volume of water is 60% and the temperature is 60° C.

4. The method of claim 3 wherein the aluminum wire is in contact with the aqeuous solution for from 7 to 20 seconds.

5. The method of claim 4 wherein the aluminum wire is in contact with the aqueous solution for 13.33 seconds.

6. The method of claim 2 wherein the nickel is electroplated on the prepared aluminum wire by passing said wire through an aqueous nickel plating bath.

7. The method of claim 6 wherein the aqueous nickel bath contains nickel and a nickel salt selected from the group consisting of nickel fluoroborate and nickel sulfamate.

* * * * *